US008901425B2

(12) United States Patent
Varkey et al.

(10) Patent No.: US 8,901,425 B2
(45) Date of Patent: Dec. 2, 2014

(54) WIRELINE CABLES NOT REQUIRING SEASONING

(75) Inventors: Joseph Varkey, Sugar Land, TX (US); Vadim Protasov, Houston, TX (US); Jushik Yun, Sugar Land, TX (US); Sheng Chang, Sugar Land, TX (US)

(73) Assignee: Schlumberger Technology Corporatoon, Sugar Land, TX (US)

( * ) Notice: Subject to any disclaimer, the term of this patent is extended or adjusted under 35 U.S.C. 154(b) by 452 days.

(21) Appl. No.: 13/271,577

(22) Filed: Oct. 12, 2011

(65) Prior Publication Data

US 2012/0097419 A1 Apr. 26, 2012

Related U.S. Application Data

(60) Provisional application No. 61/393,611, filed on Oct. 15, 2010.

(51) Int. Cl.

| | |
|---|---|
| ***H01B 7/00*** | (2006.01) |
| ***H01B 7/04*** | (2006.01) |
| *H01B 7/22* | (2006.01) |
| *H01B 13/22* | (2006.01) |

(52) U.S. Cl.

CPC ..... *H01B 7/046* (2013.01); *H01B 7/226* (2013.01); *H01B 13/221* (2013.01)

USPC ..... 174/102 R; 174/103; 174/105 R; 174/106 R; 174/108; 174/109

(58) Field of Classification Search

USPC ..... 174/102 R, 103, 104, 105, 106 R, 107, 174/108, 109

See application file for complete search history.

(56) References Cited

U.S. PATENT DOCUMENTS

| | | | | |
|---|---|---|---|---|
| 3,482,034 | A * | 12/1969 | Rhoades et al. | 174/102 R |
| 3,681,514 | A * | 8/1972 | Rhoades et al. | 174/108 |
| 4,409,431 | A * | 10/1983 | Neuroth | 174/103 |
| 5,150,443 | A * | 9/1992 | Wijnberg | 385/107 |
| 6,559,385 | B1 * | 5/2003 | Johnson et al. | 174/126.1 |
| 6,600,108 | B1 * | 7/2003 | Mydur et al. | 174/120 R |
| 7,462,781 | B2 * | 12/2008 | Varkey et al. | 174/102 R |
| 2006/0211286 | A1 * | 9/2006 | Shuey | 439/157 |
| 2007/0000682 | A1 * | 1/2007 | Varkey et al. | 174/102 R |
| 2007/0044991 | A1 * | 3/2007 | Varkey | 174/102 R |
| 2009/0089998 | A1 | 4/2009 | Varkey | |
| 2009/0283295 | A1 | 11/2009 | Varkey et al. | |
| 2010/0263904 | A1 | 10/2010 | Varkey et al. | |

* cited by examiner

*Primary Examiner* — William H Mayo, III

(74) *Attorney, Agent, or Firm* — Trevor Grove

(57) ABSTRACT

A cable includes an electrically conductive cable core for transmitting electrical power and data, an insulative/protective layer circumferentially disposed around the core, an inner armor wire layer including a plurality of armor wires disposed around the cable core and the insulative layer, wherein at least one of the armor wires of the inner armor wire layer is bonded to the insulative layer, and an outer armor wire layer including a plurality of armor wires disposed around the inner armor wire layer. At least one of the armor wires of the outer armor wire layer can be bonded to the at least one of the armor wires of the inner armor wire layer.

12 Claims, 7 Drawing Sheets

WIRELINE CABLES NOT REQUIRING SEASONING

CROSS REFERENCE TO RELATED APPLICATIONS

This application claims priority as a nonprovisional of U.S. Provisional Patent Application No. 61/393,611, filed Oct. 15, 2010. The disclosures of each of the priority applications are incorporated by reference herein in their entireties.

BACKGROUND

The statements in this section merely provide background information related to the present disclosure and may not constitute prior art.

The invention is related in general to well site equipment such as wireline surface equipment, wireline cables and the like.

A process of removing the plastic stretch from a cable by allowing contra-helical armor layers on the cable to seat properly is known as "seasoning" of the cable. Cables are often "seasoned" in order to minimize damage to the cable and provide accurate depth measurements.

A seasoning process can include a "pre-stress" operation accomplished by subjecting a cable in an ends-fixed condition to high stresses at elevated temperatures. By performing the pre-stress operation, plastic stretch is partially removed from the cable, which allows the armor to arrange itself on the cable core. A pre-stressed cable has to be further "broken-in" during the first couple of visits to the well site. The process of "breaking-in" is done by running cable into a well, while carrying a heavy tool string which is free to rotate. Running in speed during the seasoning process has to be much slower compared to that for the "seasoned" cable. Cables armored with galvanized steel armor undergo seasoning quite well, which is attributed to the properties of the galvanized steel armor package. On the other hand, alloy cables having smooth non-corrosive armor do not season.

Specifically, alloy armor has smooth, almost slick, properties which inhibit corrosion and allow the armor to slide around much more freely. Therefore, "seasoning" cannot be applied to alloy cables, creating a number of operational issues. Certain alloy cables are highly torque imbalanced which manifests itself through excessive rotation downhole and resulting in a stretch on the alloy armor cable that is higher than a galvanized steel armored cable. This torque imbalance may also create an issue with accurate depth measurement. Accordingly, the probability of bird caging of the alloy armor cable is higher than with galvanized steel armored cabled.

Taking this into account, well site operations with alloy cable are much more time consuming, as running in and pulling out of the hole has to be done at speeds much slower than that of galvanized armored cable.

It remains desirable to provide improvements in wireline cables and/or downhole assemblies.

SUMMARY

The present disclosure provides a cable that does not require seasoning or pre-stressing operations. Designs provided below are equally applicable to any cable configuration (mono, coax, triad, quad, hepta or any other) having various armor layers (e.g. steel, alloy, and the like).

In an embodiment, a cable comprises: an electrically conductive cable core for transmitting electrical power and data, such as telemetric data or the like; an insulative and/or protective jacket or layer circumferentially disposed around the core; an inner armor wire layer including a plurality of armor wires disposed around the insulative/protective layer, wherein at least one of the armor wires of the inner armor wire layer is bonded to the insulative layer; and an outer armor wire layer including a plurality of armor wires disposed around the inner armor wire layer.

In an embodiment, a cable comprises: an electrically conductive cable core for transmitting electrical power; a insulative layer circumferentially disposed around the core; an inner armor wire layer including a plurality of armor wires disposed around the insulative/protective layer, wherein at least one of the armor wires of the inner armor wire layer includes a coating bonded to the insulative/protective layer to substantially fix a position of the at least one of the armor wires of the inner armor wire layer relative to the insulative/protective layer; and an outer armor wire layer including a plurality of armor wires disposed around the inner armor wire layer.

Methods for construction of a wireline cable are also disclosed.

In an embodiment, a method comprises the steps of: providing an electrically conductive cable core for transmitting electrical power and data; disposing a insulative/protective layer circumferentially around the core; providing an inner armor wire layer including a plurality of armor wires, wherein at least one of the armor wires of the inner armor wire layer includes a coating; heating the coating of the at least one of the armor wires of the inner armor wire layer to soften the coating; disposing the inner armor wire layer around the insulative layer, wherein the coating of the at least one of the armor wires of the inner armor wire layer is bonded to the insulative/protective layer to substantially fix a position of the at least one of the armor wires of the inner armor wire layer relative to the insulative/protective layer; and disposing an outer armor wire layer around the inner armor wire layer, the outer armor wire layer including a plurality of armor wires.

BRIEF DESCRIPTION OF THE DRAWINGS

These and other features and advantages of the present disclosure will be better understood by reference to the following detailed description when considered in conjunction with the accompanying drawings wherein.

DETAILED DESCRIPTION OF THE INVENTION

Figure 1:
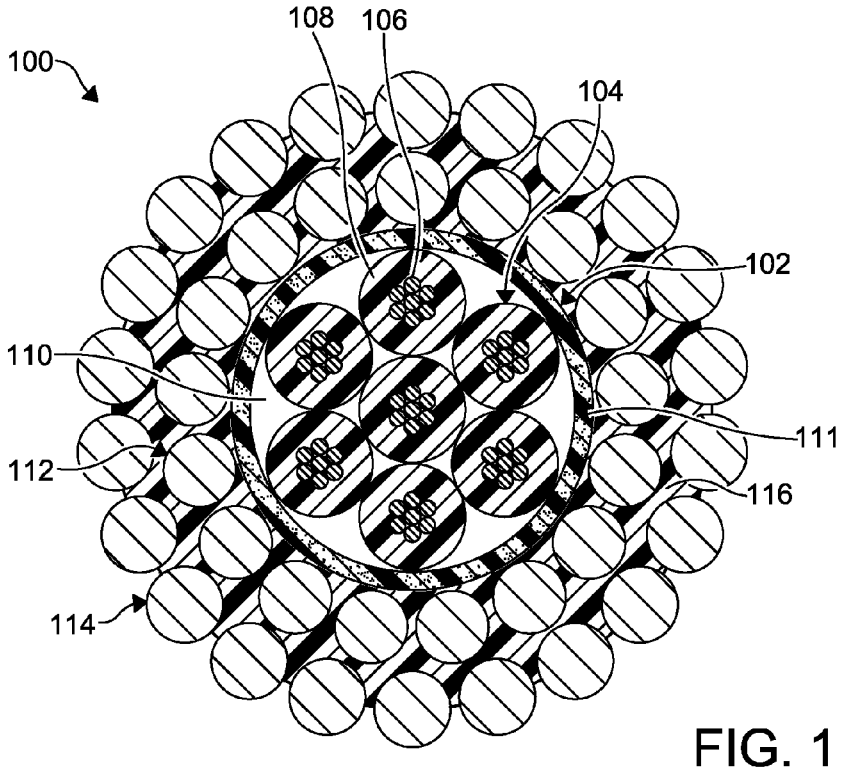
FIG. 1 is a radial cross-sectional view of a first embodiment of a cable.

Referring to FIG. 1, there is illustrated a cable 100 according to a first embodiment of the present disclosure. As shown, the cable 100 includes a core 102 having a plurality of conductors 104. As a non-limiting example, each of the conductors 104 is formed from a plurality of conductive strands 106 disposed adjacent each other with an insulator 108 disposed therearound. As a further non-limiting example, the core 102 includes seven distinctly insulated conductors 104 disposed in a hepta-cable configuration. However, any number of conductors 104 can be used in any configuration, as desired. In certain embodiments an interstitial void 110 formed between adjacent insulators 108 is filled with a semi-conductive (or non-conductive) filler (e.g. filler strands, polymer insulator filler).

A layer of insulative or protective material 111 (e.g. polymer) is circumferentially disposed around the core 102. As a non-limiting example, the insulative material is a short-fiber-reinforced polymer extruded over the core 102. However, other materials and methods of insulating the core can be used. The material 111 may be an insulative material, a protective material, or both an insulative material and protective material.

The core 102 and the insulative layer 111 are surrounded by an inner layer of alloy armor wires 112 (e.g. high modulus steel strength members) that are cabled at a pre-determined lay angle. In certain embodiments, the inner layer 112 is at least partially embedded in the layer of insulative material 111. The inner layer 112 is surrounded by an outer layer of alloy armor wires 114. As a non-limiting example the layers 112, 114 are contra helically wound with each other. As a non-limiting example, an interstitial void created in the layers 112, 114 (e.g. between adjacent ones of the armor wires of the inner layer 112 and the outer layer 114) is filled with a polymer as part of a jacket 116. In the embodiment shown, the jacket 116 encapsulates the inner layer 112 and covers at least a portion of the outer layer 114. It is understood that the jacket 116 can cover any portion of the layers 112, 114.

In operation, the cable 100 is coupled to a tractor in a configuration known in the art. The cable 100 is introduced into the wellbore, without the requirement of seasoning or pre-stressing operations. It is understood that various tool strings can be coupled to the cable 100 and/or the tractor to perform various well service operations known in the art.

Figure 2:
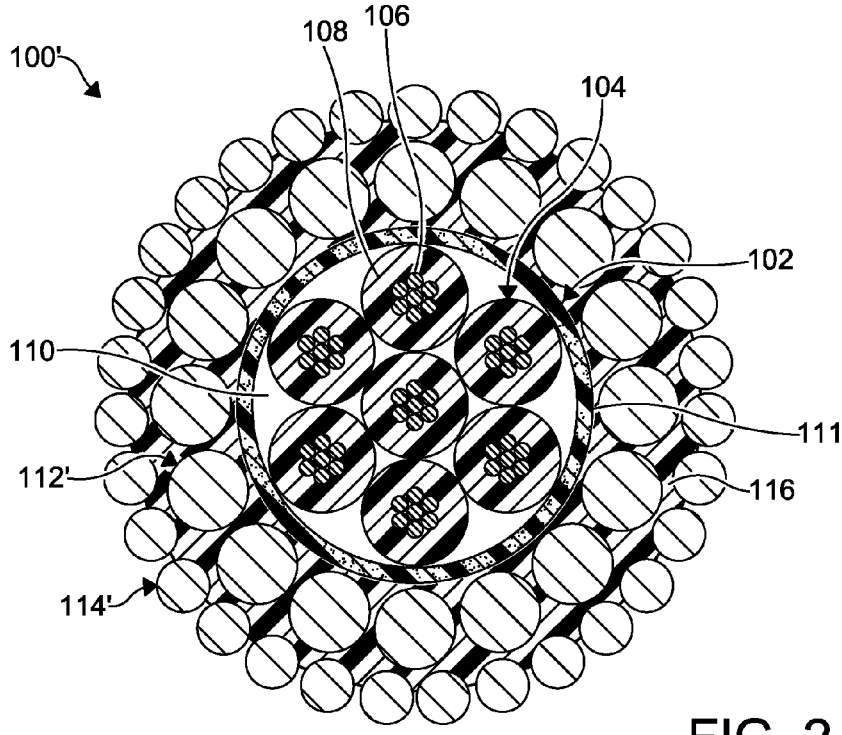
FIG. 2 is a radial cross-sectional view of a second embodiment of a cable.

FIG. 2 illustrates a torque balanced cable 100' for tractor or other toolstring operations according to a second embodiment of the present disclosure similar to the cable 100, except as described below. As shown, the core 102 is surrounded by an inner layer of alloy armor wires 112' (e.g. high modulus steel strength members) that are cabled at a pre-determined lay angle. In certain embodiments, the inner layer 112' is at least partially embedded in the layer of insulative material 111. The inner layer 112' is surrounded by an outer layer of alloy armor wires 114'. As a non-limiting example the layers 112', 114' are contra helically wound with each other. As shown, a coverage or size of the outer layer 114' relative to the inner layer 112' is configured to substantially match a torque generated by the inner layer 112'. As a non-limiting example the coverage of the outer layer 114' over the inner layer is between about 50% to about 90%. It is understood that a reduction in the coverage allows the cable 100' to achieve torque balance and advantageously minimizes a weight of the cable 100'. As a further non-limiting example, layers 112', 114' of the cable 100' are configured similar to the cable described in U.S. Pat. Appl. Pub. No. 2009/0283295, hereby incorporated herein by reference in its entirety.

In operation, the cable 100' is coupled to a tractor in a configuration known in the art. The cable 100' is introduced into the wellbore, wherein a torque on the cable 100' is substantially balanced. It is understood that various tool strings can be coupled to the cable 100' and the tractor or other toolstring to perform various well service operations known in the art.

Figure 3:
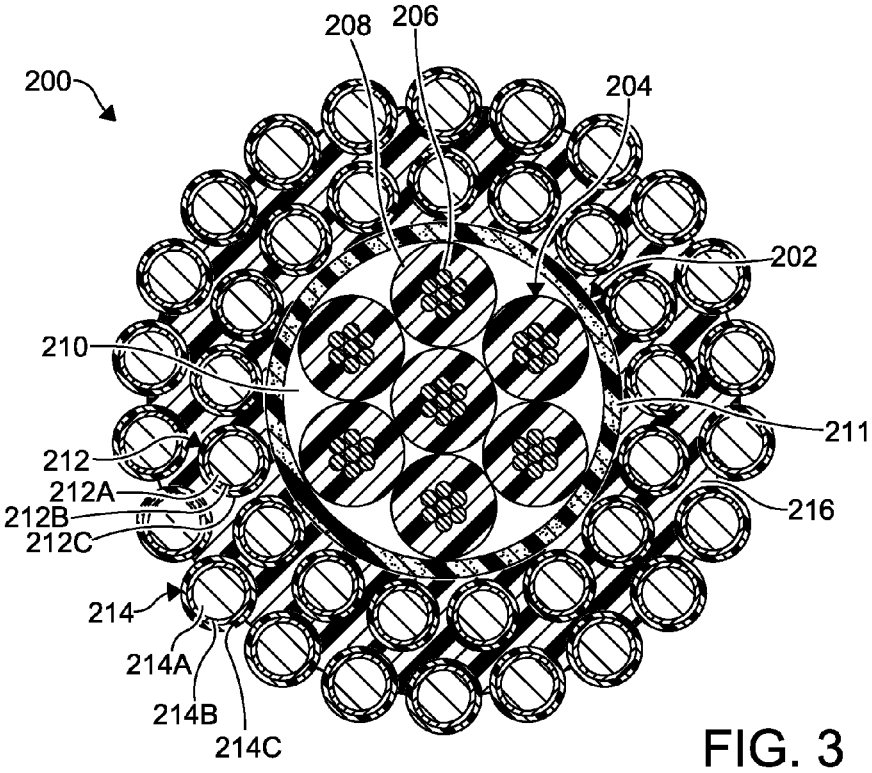
FIG. 3 is a radial cross-sectional view of a third embodiment of a cable.

FIG. 3 illustrates a cable 200 according to a third embodiment of the present disclosure similar to the cable 100, except as described below. As shown, the cable 200 includes a core 202 having a plurality of conductors 204. As a non-limiting example, each of the conductors 204 is formed from a plurality of conductive strands 206 disposed adjacent each other with an insulator 208 disposed therearound. As a further non-limiting example, the core 202 includes seven distinctly insulated conductors 204 disposed in a hepta-cable configuration. However, any number of conductors 204 can be used in any configuration, as desired. In certain embodiments an interstitial void 210 formed between adjacent insulators 208 is filled with a semi-conductive (or non-conductive) filler (e.g. filler strands, polymer insulator filler, gunk).

A layer of insulative material 211 (e.g. polymer and/or composite) is circumferentially disposed around the core 202. As a non-limiting example, the insulative material is a short-fiber-reinforced polymer extruded over the core 202. However, other materials and methods of insulating the core can be used. The material 211 may be an insulative material, a protective material, or both an insulative material and protective material.

The core 202 and the insulative layer 211 are surrounded by an inner layer of alloy armor wires 212 (steel strength members) that are cabled at a pre-determined lay angle. In certain embodiments, the inner layer 212 is at least partially embedded in the layer of insulative material 211. The inner layer 212 is surrounded by an outer layer of alloy armor wires 214. As a non-limiting example the layers 212, 214 are contra helically wound with each other. As a non-limiting example, an interstitial void created in the layers 212, 214 (e.g. between adjacent ones of the armor wires of the inner layer 212 and the outer layer 214) is filled with a polymer as part of a jacket 216. In the embodiment shown, the jacket 216 encapsulates the inner layer 212 and covers at least a portion of the outer layer 214. It is understood that the jacket 216 can cover any portion of the layers 212, 214.

As a non-limiting example, each of the alloy armor wires of the layers 212, 214 includes an alloy (or steel) core wire 212A, 214A coated with a tie layer 212B, 214B and an outer polymer coating 212C, 214C to bond to the polymeric jacket 216. As a further non-limiting example, each of the tie layers 212B, 214B can be formed from brass, zinc, aluminum, or other suitable material to bond the alloy core wire 212A, 214A to the polymer coating 212C, 214C. Therefore, the polymeric jacket 216 becomes a composite in which the layers 212, 214 are embedded in a continuous matrix of polymer from the core 202 to an outer surface of the jacket 216.

In operation, the cable 200 is coupled to a tractor or another toolstring in a configuration known in the art. The cable 200 is introduced into the wellbore, without the requirement of seasoning or pre-stressing operations. It is understood that various tool strings can be coupled to the cable 200 and the tractor to perform various well service operations known in the art. It is further understood that the bonding of the layers 212, 214 to the jacket 216 minimizes stripping of the jacket 216.

Figure 4:
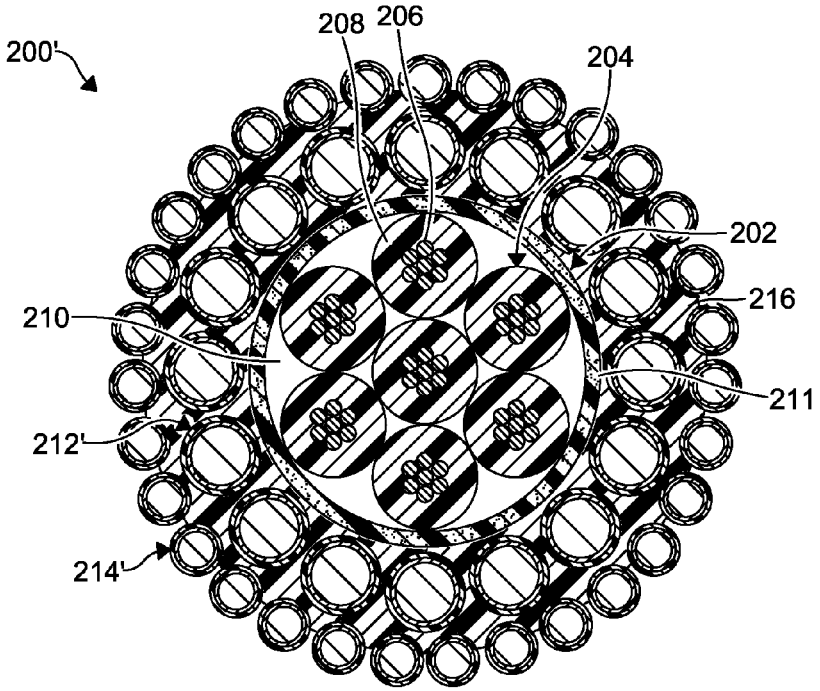
FIG. 4 is a radial cross-sectional view of a fourth embodiment of a cable.

FIG. 4 illustrates a torque balanced cable 200' according to a fourth embodiment of the present disclosure similar to the cable 200, except as described below. As shown, the core 202 is surrounded by an inner layer of alloy armor wires 212' (e.g. high modulus steel strength members) that are cabled at a pre-determined lay angle. In certain embodiments, the inner layer 212' is at least partially embedded in the layer of insulative material 211. The inner layer 212' is surrounded by an outer layer of alloy armor wires 214'. As a non-limiting example the layers 212', 214' are contra helically wound with each other. As shown, a coverage or size of the outer layer 214' relative to the inner layer 212' is configured to substantially match a torque generated by the inner layer 212'. As a non-limiting example the coverage of the outer layer 214' over the inner layer is between about 50% to about 90%. It is understood that a reduction in the coverage allows the cable 200' to achieve torque balance and advantageously minimizes a weight of the cable 200'. As a further non-limiting example, layers 212', 214' of the cable 200' are configured similar to the cable described in U.S. Pat. Appl. Pub. No. 2009/0283295, hereby incorporated herein by reference in its entirety.

In operation, the cable 200' is coupled to a tractor or other toolstring in a configuration known in the art. The cable 200' is introduced into the wellbore, wherein a torque on the cable 200' is substantially balanced. It is understood that various tool strings including a tractor can be coupled to the cable 200' and the tractor to perform various well service operations known in the art.

Figure 5:
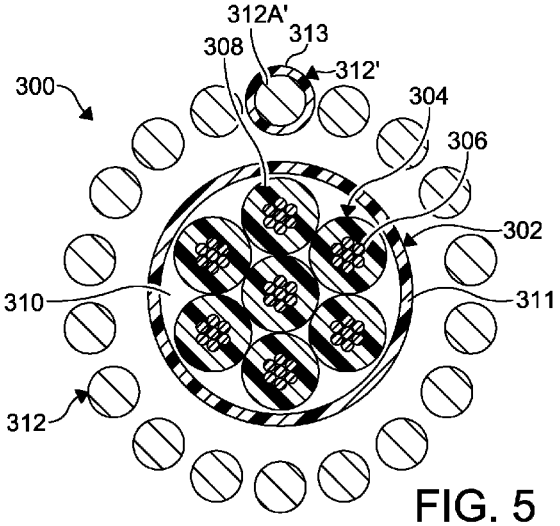
FIG. 5 is a partially exploded radial cross-sectional view of a portion of a fifth embodiment of a cable.
Figure 6:
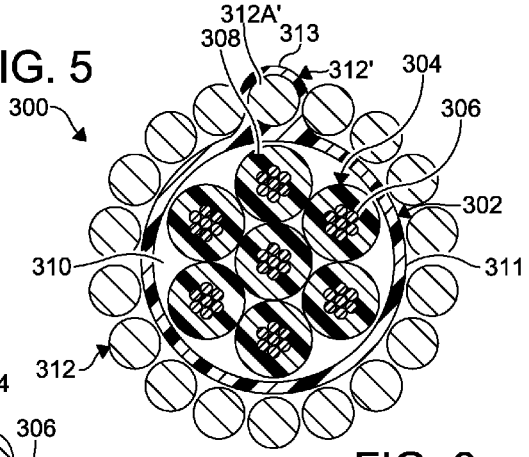
FIG. 6 is a radial cross-sectional view of the cable of FIG. 5.
Figure 7:
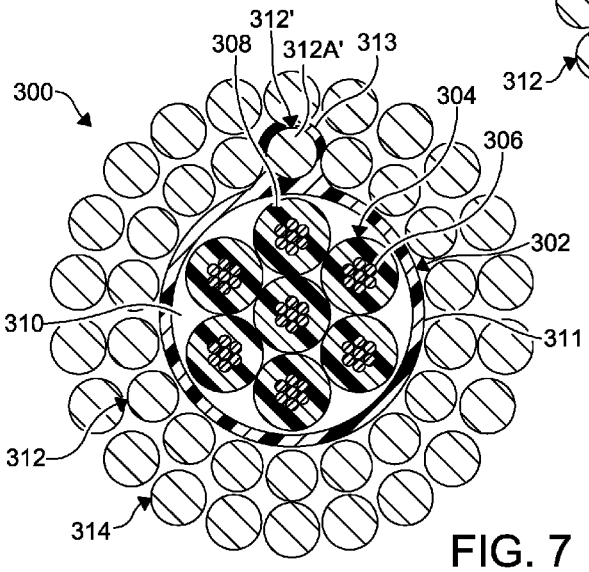
FIG. 7 is a radial cross-sectional view of the cable of FIG. 5, including an outer layer of armor wires.

FIGS. 5-7 illustrate a cable 300 for tractor operations according to a fifth embodiment of the present disclosure similar to the cable 100, except as described below. As shown, the cable 300 includes a core 302 having a plurality of conductors 304. As a non-limiting example, each of the conductors 304 is formed from a plurality of conductive strands 306 disposed adjacent each other with an insulator 308 disposed therearound. As a further non-limiting example, the core 302 includes seven distinctly insulated conductors 304 disposed in a hepta-cable configuration. However, any number of conductors 304 can be used in any configuration, as desired. In certain embodiments interstitial voids 310 formed between adjacent insulators 308 are filled with a semi-conductive (or non-conductive) filler (e.g. filler strands, polymer insulator filler, or gunk).

A layer of insulative material 311 (e.g. polymer) is circumferentially disposed around the core 302. As a non-limiting example, the insulative material is a short-fiber-reinforced polymer extruded over the core 302. However, other materials and methods of insulating the core can be used. The material 311 may be an insulative material, a protective material, or both an insulative material and protective material.

The core 302 and the insulative layer 311 are surrounded by an inner layer of alloy or steel armor wires 312 (e.g. high modulus steel strength members) that are cabled at a pre-determined lay angle. A coated one 312' of the armor wires of the inner layer 312 includes a polymer coating 313 that bonds to an armor wire core 312A' of the coated armor wire 312'. As the inner layer of alloy armor wires 312 is cabled together over the insulative material 311 covering the core 302, a heat source (for example, infrared heating) is applied to soften the polymer coating 313 on the coated armor wire 312' of the inner layer 312. It is understood that various sources of thermal energy can be used such as infrared heaters emitting short, medium or long infrared waves, ultrasonic waves, microwaves, lasers, other suitable electromagnetic waves, conventional heating, induction heating, and the like. As the inner layer 312 seats against the core 302, the polymer coating 313 of the coated armor wire 312' bonds to the layer of insulative material 311 and deforms to fill interstitial spaces between the coated armor wire 312' and the adjacent armor wires. The inner layer 312 is surrounded by an outer layer of an alloy or steel armor wires 314, further locking the inner layer 312 into place and minimizing any stretching of the cable 302.

In operation, the cable 300 is coupled to a tractor in a configuration known in the art. The cable 300 is introduced into the wellbore, without the requirement of seasoning or pre-stressing operations. It is understood that various tool strings can be coupled to the cable 300 and the tractor to perform various well service operations known in the art. It is further understood that layers 312, 314 maybe be formed from galvanized improved plow steel (GIPS) or alloy armor wire strength members.

Figure 8:
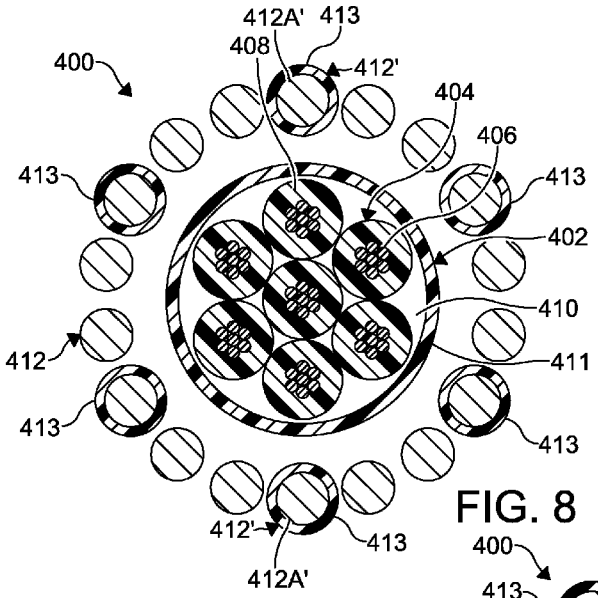
FIG. 8 is a partially exploded radial cross-sectional view of a portion of a sixth embodiment of a cable.
Figure 9:
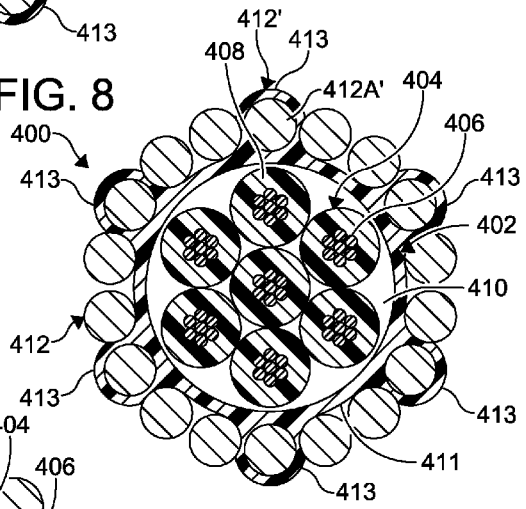
FIG. 9 is a radial cross-sectional view of the cable of FIG. 8.
Figure 10:
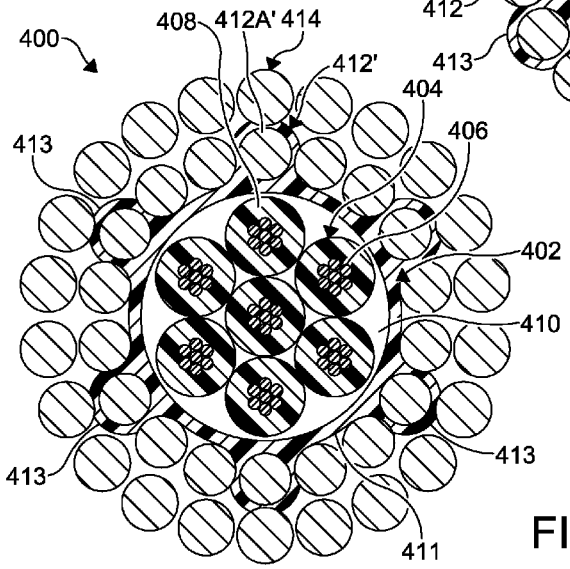
FIG. 10 is a radial cross-sectional view of the cable of FIG. 8, including an outer layer of armor wires.

FIGS. 8-10 illustrate a cable 400 for tractor operations according to a fifth embodiment of the present disclosure similar to the cable 300, except as described below. As shown, the cable 400 includes a core 402 having a plurality of conductors 404. As a non-limiting example, each of the conductors 404 is formed from a plurality of conductive strands 406 disposed adjacent each other with an insulator 408 disposed therearound. As a further non-limiting example, the core 402 includes seven distinctly insulated conductors 404 disposed in a hepta-cable configuration. However, any number of conductors 404 can be used in any configuration, as desired. In certain embodiments an interstitial void 410 formed between adjacent insulators 408 is filled with a semi-conductive (or non-conductive) filler (e.g. filler strands, polymer insulator filler).

A layer of insulative material 411 (e.g. polymer) is circumferentially disposed around the core 402. As a non-limiting example, the insulative material is a short-fiber-reinforced polymer extruded over the core 402. However, other materials and methods of insulating the core can be used. The material 411 may be an insulative material, a protective material, or both an insulative material and protective material.

The core 402 is surrounded by an inner layer of alloy armor wires 412 (e.g. high modulus steel strength members) that are cabled at a pre-determined lay angle. A plurality of coated ones 412' of the armor wires of the inner layer 412 include a polymer coating 413 that bonds to an armor wire core 412A' of the coated armor wires 412'. As the inner layer of alloy armor wires 412 is cabled together over the insulative material 411 covering the core 402, a heat source is applied to slightly soften the polymer coating 413 on the coated armor wire 412' of the inner layer 412. As the inner layer 412 seats against the core 402, the polymer coating 413 of each of the coated armor wires 412' bonds to the layer of insulative material 411 and deforms to fill interstitial spaces between the coated armor wire 412' and the adjacent armor wires of the inner layer 412. The inner layer 412 is surrounded by an outer layer of alloy armor wires 414, further locking the inner layer 412 into place and minimizing any stretching of the cable 402.

In operation, the cable 400 is coupled to a tractor in a configuration known in the art. The cable 400 is introduced into the wellbore, without the requirement of seasoning or pre-stressing operations. It is understood that various tool strings can be coupled to the cable 400 and the tractor to perform various well service operations known in the art. It is further understood that layers 412, 414 maybe be formed from Galvanized Improved Plow Steel (GIPS), steel, other metals or alloy armor wire strength members.

Figure 11:
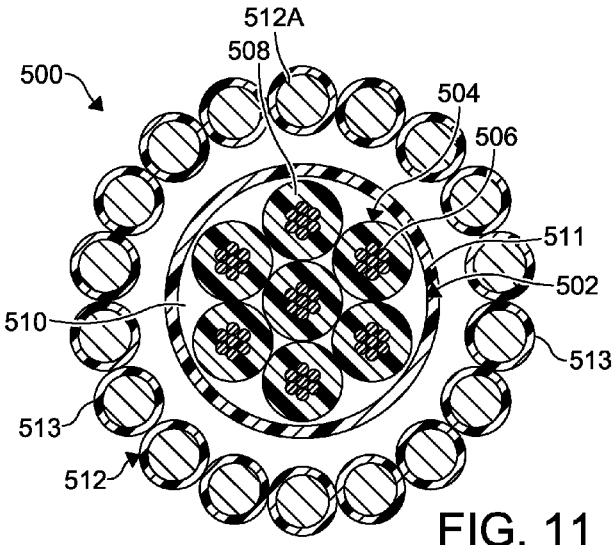
FIG. 11 is a partially exploded radial cross-sectional view of a portion of a seventh embodiment of a cable.
Figure 12:
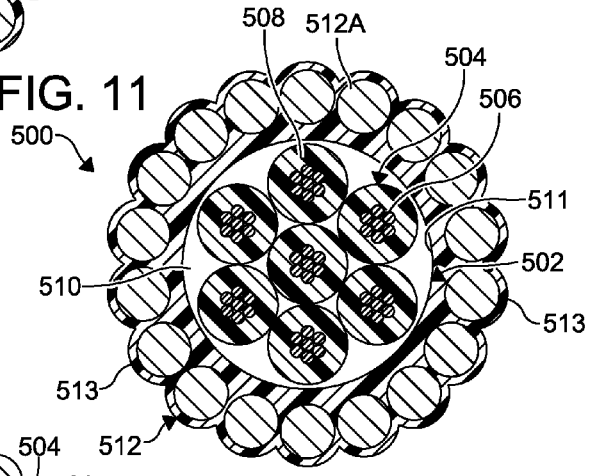
FIG. 12 is a radial cross-sectional view of the cable of FIG. 11.
Figure 13:
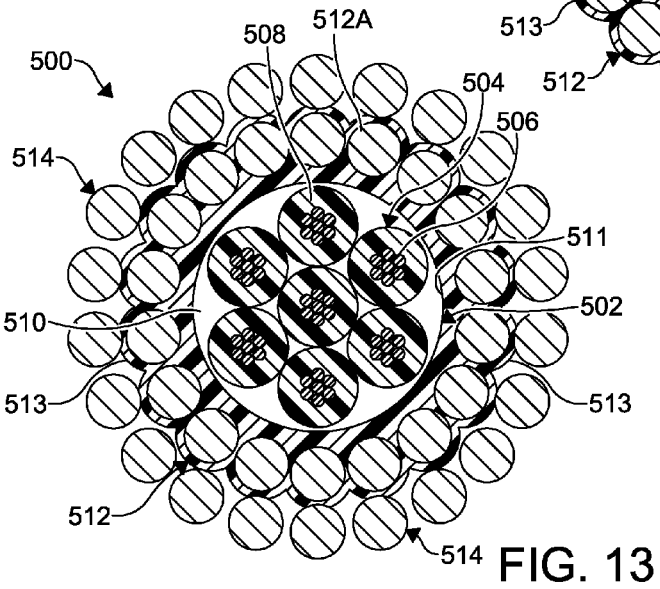
FIG. 13 is a radial cross-sectional view of the cable of FIG. 11, including an outer layer of armor wires.
Figure 14:
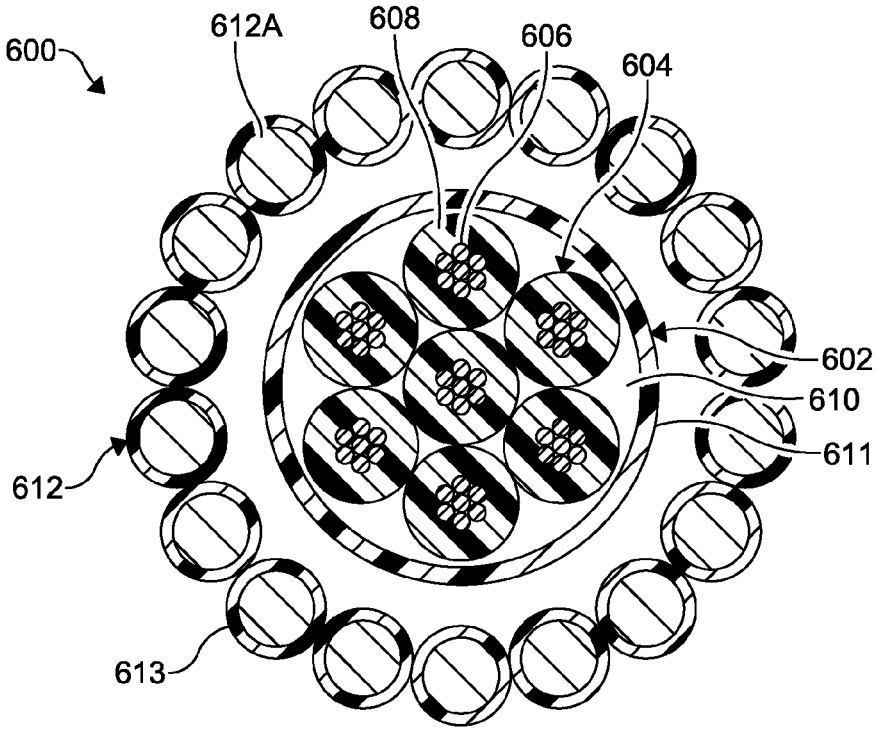
FIG. 14 is a partially exploded radial cross-sectional view of a portion of an eight embodiment of a cable.
Figure 15:
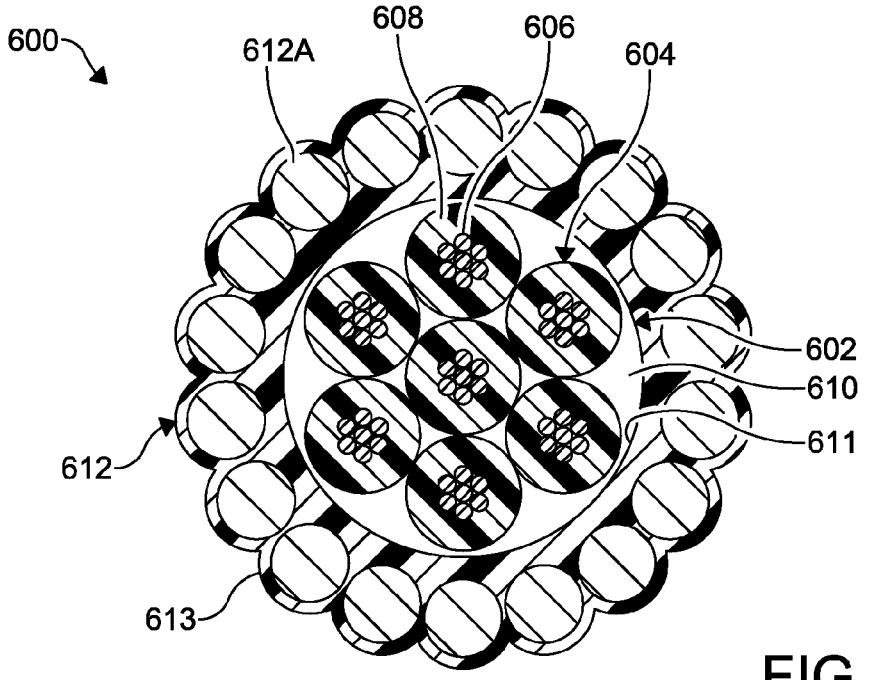
FIG. 15 is a radial cross-sectional view of the cable of FIG. 14.
Figure 16:
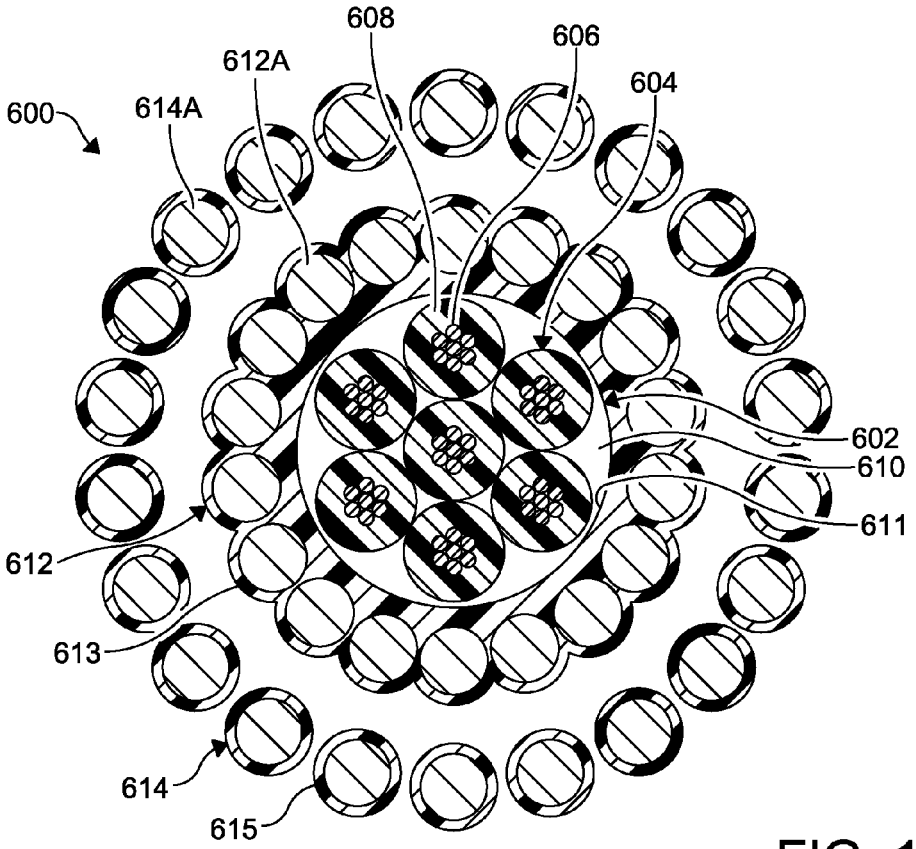
FIG. 16 is a partially exploded radial cross-sectional view of the cable of FIG. 14, including an outer layer of armor wires.
Figure 17:
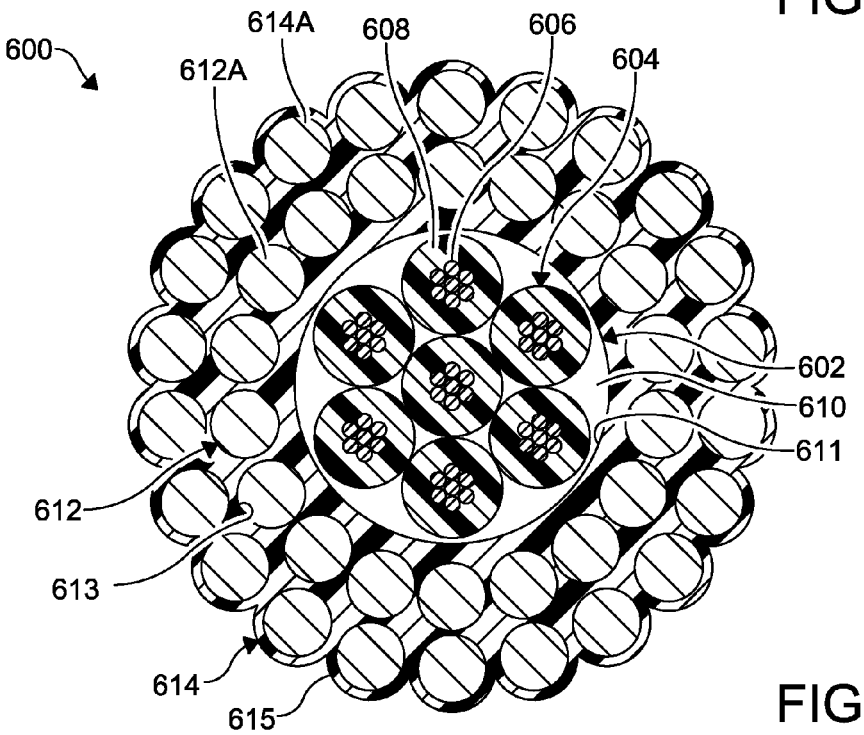
FIG. 17 is a radial cross-sectional view of the cable of FIG. 16.

FIGS. 11-13 illustrate a cable 500 for tractor operations according to a fifth embodiment of the present disclosure similar to the cable 300, except as described below. As shown, the cable 500 includes a core 502 having a plurality of conductors 504. As a non-limiting example, each of the conductors 504 is formed from a plurality of conductive strands 506 disposed adjacent each other with an insulator 508 disposed therearound. As a further non-limiting example, the core 502 includes seven distinctly insulated conductors 504 disposed in a hepta-cable configuration. However, any number of conductors 504 can be used in any configuration, as desired. In certain embodiments interstitial voids 510 formed between adjacent insulators 508 is filled with a semi-conductive (or non-conductive) filler (e.g. filler strands, polymer insulator filler, gunk).

A layer of insulative material 511 (e.g. polymer) is circumferentially disposed around the core 502. As a non-limiting example, the insulative material is a short-fiber-reinforced polymer extruded over the core 502. However, other materials and methods of insulating and/or protecting the core can be used. The material 511 may be an insulative material, a protective material, or both an insulative material and protective material.

The core 502 and the insulative material 511 are surrounded by an inner layer of alloy or steel armor wires 512 (e.g. high modulus steel strength members) that are cabled at a pre-determined lay angle. Each of the armor wires of the inner layer 512 include a polymer coating 513 that bonds to an armor wire core 512A of the armor wires of the inner layer 512 As the inner layer of alloy or steel armor wires 512 is cabled together over the insulative material 511 covering the core 502, a heat source is applied to soften the polymer coating 513 on each of the armor wires of the inner layer 512. As the inner layer 512 seats against the core 502, the polymer coating 513 of each of the armor wires bonds to the layer of insulative material 511 and deforms to fill interstitial spaces between the adjacent armor wires of the inner layer 512. The inner layer 512 is surrounded by an outer layer of alloy or steel armor wires 514, further locking the inner layer 512 into place and minimizing any stretching of the cable 502.

In operation, the cable 500 is coupled to a tractor in a configuration known in the art. The cable 500 is introduced into the wellbore, without the requirement of seasoning or pre-stressing operations. It is understood that various tool strings can be coupled to the cable 500 and including the tractor to perform various well service operations known in the art. It is further understood that layers 512, 514 maybe be formed from GIPS, steel, other metals or alloy armor wire strength members.

FIGS. 14-17 illustrate a cable 600 for tractor operations according to a fifth embodiment of the present disclosure similar to the cable 300, except as described below. As shown, the cable 600 includes a core 602 having a plurality of conductors 604. As a non-limiting example, each of the conductors 604 is formed from a plurality of conductive strands 606 disposed adjacent each other with an insulator 608 disposed therearound. As a further non-limiting example, the core 602 includes seven distinctly insulated conductors 604 disposed in a hepta-cable configuration. However, any number of conductors 604 can be used in any configuration, as desired. In certain embodiments an interstitial void or voids 610 formed between adjacent insulators 608 is filled with a semi-conductive (or non-conductive) filler (e.g. filler strands, polymer insulator filler, gunk or combinations thereof).

A layer of insulative material 611 (e.g. polymer) is circumferentially disposed around the core 602. As a non-limiting example, the insulative or protective material is a short-fiber-reinforced polymer extruded over the core 602. However, other materials and methods of insulating the core can be used. The material 611 may be an insulative material, a protective material, or both an insulative material and protective material.

The core 602 and the insulative material 611 are surrounded by an inner layer of alloy armor wires 612 (e.g. high modulus steel strength members) that are cabled at a pre-determined lay angle. Each of the armor wires of the inner layer 612 include a polymer coating 613 that bonds to an armor wire core 612A of the armor wires of the inner layer 612. As the inner layer of alloy armor wires 612 is cabled together over the insulative material 611 covering the core 602, a heat source is applied to slightly soften the polymer coating 613 on each of the armor wires of the inner layer 612. As the inner layer 612 seats against the core 602, the polymer coating 613 of each of the armor wires bonds to the layer of insulative material 611 and deforms to fill interstitial spaces between the adjacent armor wires of the inner layer 612.

The inner layer 612 is surrounded by an outer layer of alloy or steel armor wires 614 (e.g. high modulus steel strength members) that are cabled at a pre-determined lay angle. Each of the armor wires of the outer layer 614 includes a polymer coating 615 that bonds to an armor wire core 614A of the armor wires of the inner layer 614. As the outer layer of alloy or steel armor wires 614 is cabled together over the inner layer 612, a heat source is applied to soften the polymer coating 613 on each of the armor wires of the outer layer 614. As the outer layer 614 seats against the inner layer 612, the polymer coating 615 of each of the armor wires in the outer layer 614 bonds to the polymer coating 613 of each of the armor wires of the inner layer 612 and deforms to fill interstitial spaces between the adjacent armor wires of each of the layers 612, 614. It is understood that any number of the armor wires of the layers 612, 614 can be coated with the polymer coating 613, 615. However, favorable results have been found with all of the armor wires of the layers 612, 614 including the polymer coating 613, 615 to ensure a more circular cable profile with no high spots.

In operation, the cable 600 is coupled to a tractor or other toolstring in a configuration known in the art. The cable 600 is introduced into the wellbore, without the requirement of seasoning or pre-stressing operations. It is understood that the fixed armor wires of the layers 612, 614 are bonded to each other and to the core 602 to secure each other in place around the core 602 and minimize any stretching of the cable 600. It is further understood that layers 612, 614 maybe be formed from GIPS or alloy armor wire strength members.

The innovative designs described above provide ways to produce steel and alloy cables that do not require seasoning or pre-stressing operations. Designs provided below are equally applicable to any cable configuration (mono, coax, triad, quad, hepta or other). The following are at least some the benefits of the embodiments disclosed herein: Fully seasoned cable; Reduced torque and therefore rotation; due to filled interstitial voids, A reduced amount of grease to seal on the cable at the well head is needed; No pressure loss due to fluid migration through interties between the armor; Increased speed for run in and out of the hole is possible; Reduced chance of bird caging or knotting; Lower stretch; Stiffer cable; and, as a consequence, faster and simpler rig up/down.

The polymeric materials useful in the cables of the invention may include, by non-limiting example, thermoplastics (such as PEEK, PEK, PEKK, PPS, Polypropylene [PP], TPX, or EPC), polyamides (such as Nylon-6, Nylon-11, Nylon-12, or Nylon-66), fluoropolymers (such as Perfluoro Ethylene Propylene [FEP], [PFA], Tefzel, etc.), and combination of the same.

In cases where it is desirable for bonding to be facilitated between materials that would not otherwise bond to a substrate, the described polymers may be amended with one of several adhesion promoters, such as: unsaturated anhydrides, (mainly maleic-anhydride, or 5-norbornene-2,3-dicarboxylic anhydride), carboxylic acid, acrylic acid, or silanes. Trade names of commercially available, amended polyolefin with these adhesion promoters include: ADMER® from Mitsui Chemical; Fusabond®, Bynel® from DuPont; Polybond® from Chemtura; TPX™ from Mitsui Chemical; and amended TPX (4-methylpentene-1 based, crystalline polyolefin) in combination with the above adhesion promoters.

Modified fluoropolymers containing adhesion promoters may also be used where needed to facilitate bonding between materials that would not otherwise bond, such as: Tefzel® from DuPont Fluoropolymers; Modified ETFE resin which is designed to promote adhesion between polyamide and fluoropolymer; Neoflon™-modified fluoropolymer from Daikin America, Inc., which is designed to promote adhesion between polyamide and fluoropolymer; ETFE (Ethylene tetrafluoroethylene) from Daikin America, Inc.; and EFEP (ethylene-fluorinated ethylene propylene) from Daikin America, Inc.

The strength members useful in the cables of the invention may include, by non-limiting example, alloy armor wire (MP35N, HC265 etc), regular steel wire, galvanized steel wire, GIPS wire, pearlitic steels, regular steel wire coated with brass, copper or zinc, followed by a bonded layer of polymer, fiber strength members, stranded armor wires, copper-clad steel, aluminum-clad steel, anodized aluminum-clad steel, titanium-clad steel, carpenter alloy 20Mo6HS, ZAPP alloy 27-7MO, GD31 Mo, austenitic stainless steel, galvanized carbon steel, copper, titanium clad copper, and any other metals, composites or alloys. As a further non-limiting example several "types" of strength members may be used, including: alloy or steel armor; alloy or steel armor wires as is or coated with brass, zinc or aluminum as a tie layer, then polymer; and stranded fiber strength members consisting of bundled filaments of steel, copper or carbon fiber in matrices of polymer, copper, zinc, aluminum, etc.

The particular embodiments disclosed above are illustrative, as the embodiments may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently disclosed embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining to the precise structures described and shown in the accompanying drawings, but rather should be read as consistent with and as support for the following claims, which are to have their fullest and fairest scope.

We claim:

1. A cable, comprising:

an electrically conductive cable core for transmitting electrical power and/or data;

an insulative layer circumferentially disposed around the core;

an inner armor wire layer including a plurality of armor wires disposed around the insulative layer, wherein only one of the armor wires of the plurality of armor wires has a coating bonded with the insulative layer and locking the armor wires in place; and an outer armor wire layer including a plurality of armor wires disposed around the inner armor wire layer.

2. The cable according to claim 1, wherein the outer armor layer covers a predetermined portion of the inner armor wire layer less than all of the inner armor wire layer to balance a torque on the cable.

3. The cable according to claim 2, wherein the insulative layer is formed from a fiber-reinforced polymer.

4. The cable according to claim 1, wherein the cable core includes a plurality of conductive strands disposed adjacent each other and embedded in an insulator.

5. The cable according to claim 1, wherein the coating is a polymer.

6. The cable according to claim 1, wherein a tie layer is located between the coating and a core of the coated armor wire.

7. The cable according to claim 1, further comprising a jacket encapsulating a portion of at least one of the inner armor wire layer and the outer armor wire layer.

8. The cable according to claim 7, wherein the jacket is bonded to the at least one of the inner armor wire layer and the outer armor wire layer.

9. A cable, comprising:

an electrically conductive cable core for transmitting electrical power and/or data;

an insulative layer circumferentially disposed around the core; an inner armor wire layer including a plurality of armor wires disposed around the insulative layer, wherein a portion of the armor wires of the inner armor wire layer includes a coating bonded to the insulative layer, wherein the portion of the armor wires with the coating are arranged symmetrically about the insulative layer, and wherein the portion of armor wires without the coating are substantially fixed in place by the armor wires with the coating and an outer armor wire layer including a plurality of armor wires disposed around the inner armor wire layer.

10. The cable according to claim 9, wherein the outer armor layer covers a predetermined portion of the inner armor wire layer less than all of the inner armor wire layer to balance a torque on the cable.

11. The cable according to claim 9, wherein at least one of the armor wires of the outer armor wire layer includes a core wire coated with an outer coating bonded to the coating of the at least one of the armor wires of the inner armor wire layer.

12. The cable according to claim 9, wherein each of the armor wires of the outer armor wire layer includes a core wire coated with an outer polymer coating bonded to outer polymer coatings of the armor wires of the inner armor wire layer.

* * * * *